US007568300B1

(12) United States Patent
McFarland et al.

(10) Patent No.: US 7,568,300 B1
(45) Date of Patent: Aug. 4, 2009

(54) COMBINATION SUPPORT STAND AND BUCKET LOCKING SYSTEM

(76) Inventors: David L. McFarland, 8191 130$^{th}$ Ave. SE., Gwinner, ND (US) 58040; Clayton A. Melrose, 405 S. 11$^{th}$ St., Oakes, ND (US) 58474

( * ) Notice: Subject to any disclaimer, the term of this patent is extended or adjusted under 35 U.S.C. 154(b) by 533 days.

(21) Appl. No.: 11/194,125

(22) Filed: Jul. 29, 2005

(51) Int. Cl.
*E01H 5/04* (2006.01)

(52) U.S. Cl. ..... 37/236; 37/234; 37/270; 37/415; 37/428

(58) Field of Classification Search ..... 37/234, 37/236, 407, 414, 415, 409, 416, 427, 428
See application file for complete search history.

(56) References Cited

U.S. PATENT DOCUMENTS

| | | | | | |
|---|---|---|---|---|---|
| 1,578,600 | A | | 3/1926 | Greatrix | |
| 2,566,901 | A | * | 9/1951 | McGee | 37/428 |
| 2,756,884 | A | * | 7/1956 | Senkowski et al. | 414/498 |
| 4,113,274 | A | * | 9/1978 | Vahrenkamp | 280/475 |
| 4,790,084 | A | * | 12/1988 | Anderson et al. | 37/403 |
| 5,369,832 | A | * | 12/1994 | Hagger | 15/83 |
| 5,540,289 | A | * | 7/1996 | Hirooka et al. | 172/274 |
| 5,692,325 | A | * | 12/1997 | Kuzutani | 37/468 |
| 5,921,743 | A | * | 7/1999 | Slagter | 414/722 |
| 6,094,847 | A | | 8/2000 | Gallenberg | 37/422 |
| 6,540,030 | B2 | | 4/2003 | Ohzeki et al. | 171/1 |
| 6,634,434 | B2 | | 10/2003 | Ohzeki et al. | 171/63 |
| 6,640,906 | B2 | | 11/2003 | Ohzeki et al. | 171/65 |
| 6,659,708 | B2 | * | 12/2003 | Heiple | 414/723 |
| 6,687,939 | B1 | * | 2/2004 | Koester | 15/83 |
| 6,805,204 | B2 | | 10/2004 | Bauer et al. | 171/111 |
| 6,902,346 | B2 | * | 6/2005 | Steig et al. | 403/322.3 |
| 7,160,076 | B2 | * | 1/2007 | Curl et al. | 414/680 |
| 7,241,101 | B2 | * | 7/2007 | Bauer et al. | 414/726 |
| 7,243,593 | B2 | * | 7/2007 | Westendorf et al. | 92/111 |

OTHER PUBLICATIONS

Dumping Hopper, www.bobcate.com, Website Printout, Publication Date Unknown.

* cited by examiner

*Primary Examiner*—Thomas B Will
*Assistant Examiner*—Mai T Nguyen

(57) ABSTRACT

A combination support stand and bucket locking system for providing both a support stand and a locking device for selectively preventing movement of a bucket with respect to an implement attached to a bucket. The combination support stand and bucket locking system includes a bucket, a locking bracket extending from the bucket, an implement that pivotally attaches to the bucket, an arm member pivotally attached to the implement wherein the distal portion of the arm member is capable of engaging the locking bracket, and an actuator connected between the arm member and the implement. The arm member includes a support stand for supporting the implement when the arm member is within the support position.

18 Claims, 9 Drawing Sheets

COMBINATION SUPPORT STAND AND BUCKET LOCKING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to support stands for tractor attachments and more specifically it relates to a combination support stand and bucket locking system for providing both a support stand and a locking device for selectively preventing movement of a bucket with respect to an implement attached to a bucket.

2. Description of the Related Art

Any discussion of the prior art throughout the specification should in no way be considered as an admission that such prior art is widely known or forms part of common general knowledge in the field.

Support stands for implements have been in use for years. Conventional support stands range from non-movable stands to manually movable stands to hydraulically movable stands. While these devices may be suitable for the particular purpose to which they address (i.e. supporting an implement), they are not as suitable for providing both a support stand and a locking device for selectively preventing movement of a bucket with respect to an accessory attached to a bucket. Conventional support stands for implements are not capable of securing a bucket to the implement in a non-movable manner.

In these respects, the combination support stand and bucket locking system according to the present invention substantially departs from the conventional concepts and designs of the prior art, and in so doing provides an apparatus primarily developed for the purpose of providing both a support stand and a locking device for selectively preventing movement of a bucket with respect to an accessory attached to a bucket.

BRIEF SUMMARY OF THE INVENTION

In view of the foregoing disadvantages inherent in the known types of support stands now present in the prior art, the present invention provides a new combination support stand and bucket locking system construction wherein the same can be utilized for providing both a support stand and a locking device for selectively preventing movement of a bucket with respect to an implement attached to a bucket.

The general purpose of the present invention, which will be described subsequently in greater detail, is to provide a new combination support stand and bucket locking system that has many of the advantages of the support stands mentioned heretofore and many novel features that result in a new combination support stand and bucket locking system which is not anticipated, rendered obvious, suggested, or even implied by any of the prior art support stands, either alone or in any combination thereof.

To attain this, the present invention generally comprises a bucket, a locking bracket extending from the bucket, an implement that pivotally attaches to the bucket, an arm member pivotally attached to the implement wherein the distal portion of the arm member is capable of engaging the locking bracket, and an actuator connected between the arm member and the implement. The arm member includes a support stand for supporting the implement when the arm member is within the support position.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a combination support stand and bucket locking system that will overcome the shortcomings of the prior art devices.

A second object is to provide a combination support stand and bucket locking system for providing both a support stand and a locking device for selectively preventing movement of a bucket with respect to an implement attached to a bucket.

Another object is to provide a combination support stand and bucket locking system that may be utilized upon various types of implements (e.g. beach cleaning implements, land cleaning implements, etc.).

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
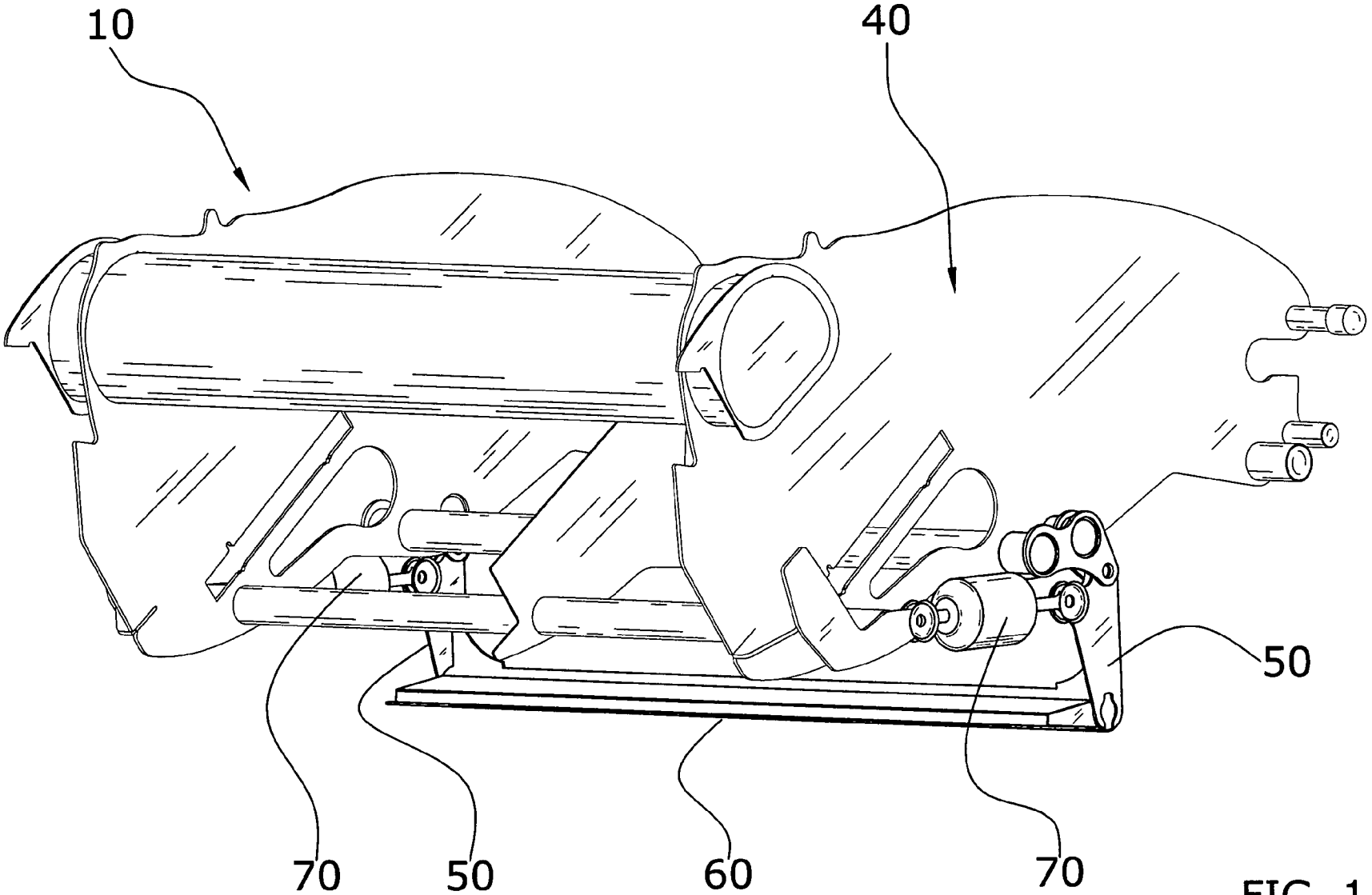
FIG. 1 is an upper perspective view of the present invention.

Turning now descriptively to the drawings, in which similar reference characters denote similar elements throughout the several views, FIGS. 1 through 9 illustrate a combination support stand and bucket locking system 10, which comprises a bucket 20, a locking bracket 30 extending from the bucket 20, an implement 40 that pivotally attaches to the bucket 20, an arm member 50 pivotally attached to the implement 40 wherein the distal portion of the arm member 50 is capable of engaging the locking bracket 30, and an actuator 70 connected between the arm member 50 and the implement 40. The arm member 50 includes a support stand 60 for supporting the implement 40 when the arm member 50 is within the support position. A front portion of the bucket 20 is preferably pivotally attached to a rear portion of the implement 40 which allows for the pivoting of the bucket 20 while attached to the implement 40 for releasing the contents of the bucket 20.

B. Bucket

FIGS. 2, 3, 4, 6 and 7 illustrate an exemplary bucket 20. The bucket 20 is designed for receiving various types of debris 12 (rocks, bottles, paper, sticks, etc.) that are cleaned from the ground surface via the implement 40. The bucket 20 design should not in any way be limited by the drawings as various other designs may be utilized to construct the bucket 20.

The bucket 20 preferably includes a pair of receiver slots 22 that catchably receive a pair of securing pins 42 extending from the implement 40 as shown in FIGS. 2, 3, 4, 6 and 7 of the drawings. The receiver slots 22 are preferably positioned within the interior side portions of the bucket 20. The securing pins 42 preferably extend outwardly from the implement 40 along a common horizontal plane. The securing pins 42 are pivotally received within the receiver slots 22 for pivotally connecting the bucket 20 with the implement 40.

A pair of locking apertures 24 preferably extend into the bucket 20 adjacent to the entry portion of the receiver slots 22. As shown in FIGS. 2, 3, 4, 6 and 7, a pair of locking pins 26 are removably extendable within the locking apertures 24. The locking pins 26 prevent removal of the securing pins 42 from the receiver slots 22 when the locking pins 26 are properly secured by preventing movement of the securing pins 42 without limiting the pivoting motion of the securing pins 42 with respect to the bucket 20.

C. Locking Bracket

A locking bracket 30 preferably extends from the bucket 20 as illustrated in FIGS. 2, 3, 4, 6 and 7 of the drawings. The locking bracket 30 preferably extends from a front end of the bucket 20 as further shown in FIGS. 2, 3, 4, 6 and 7 of the drawings. The locking bracket 30 preferably extends forwardly and substantially along an entire width of the bucket 20.

D. Implement

FIGS. 2, 3, 4, 6 and 7 illustrate an exemplary implement 40 that pivotally attaches with the bucket 20. The implement 40 may be comprised of various types of machines such as but not limited to ground surface cleaning machines. U.S. Pat. No. 6,094,847 illustrates an exemplary ground surface cleaning machine that is incorporated by reference into this application. Various other implements 40 may be utilized with respect to the present invention.

E. Arm Member

Figure 2:
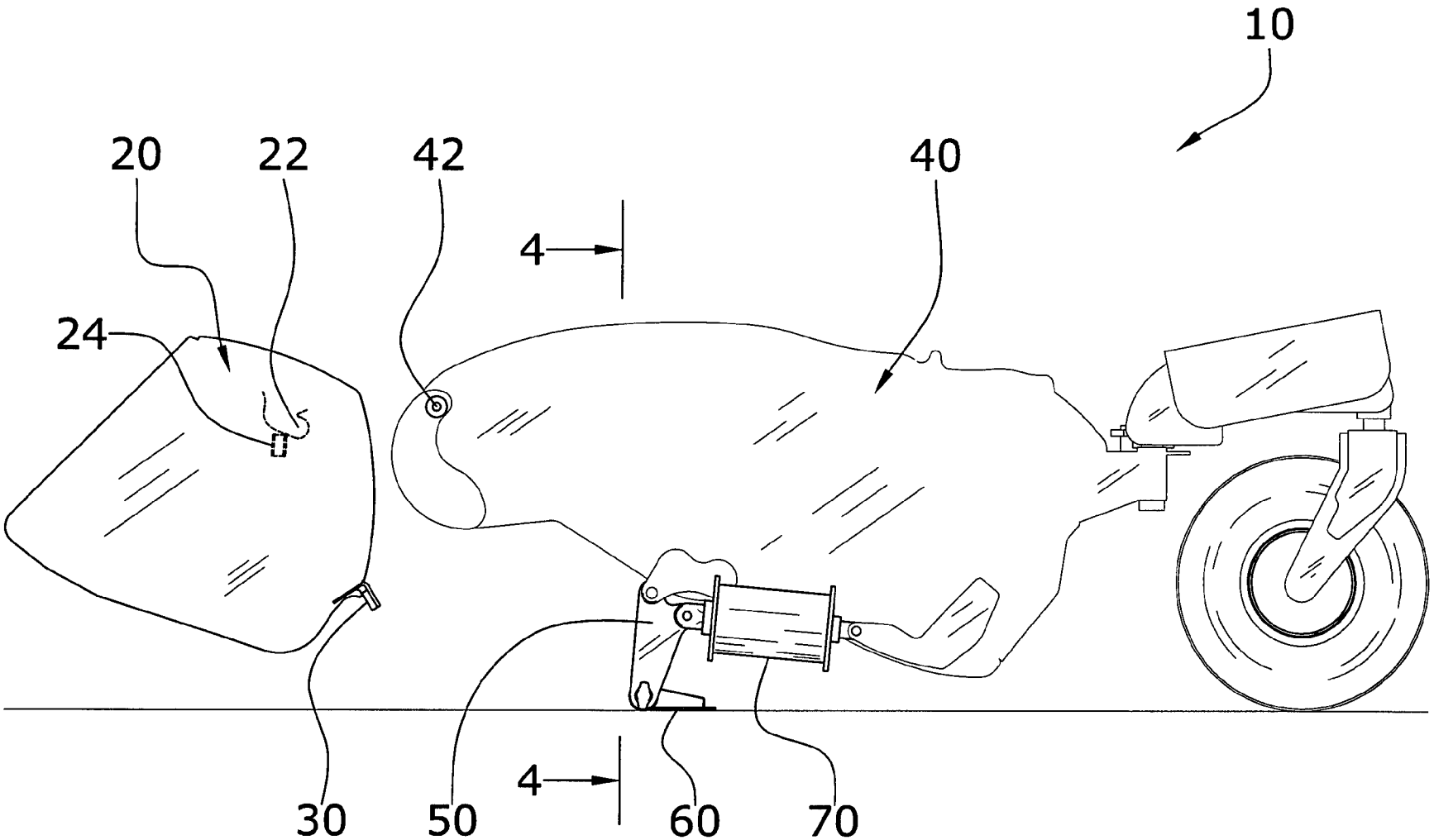
FIG. 2 is a side view of the present invention in the support stand position for supporting the implement.
Figure 3:
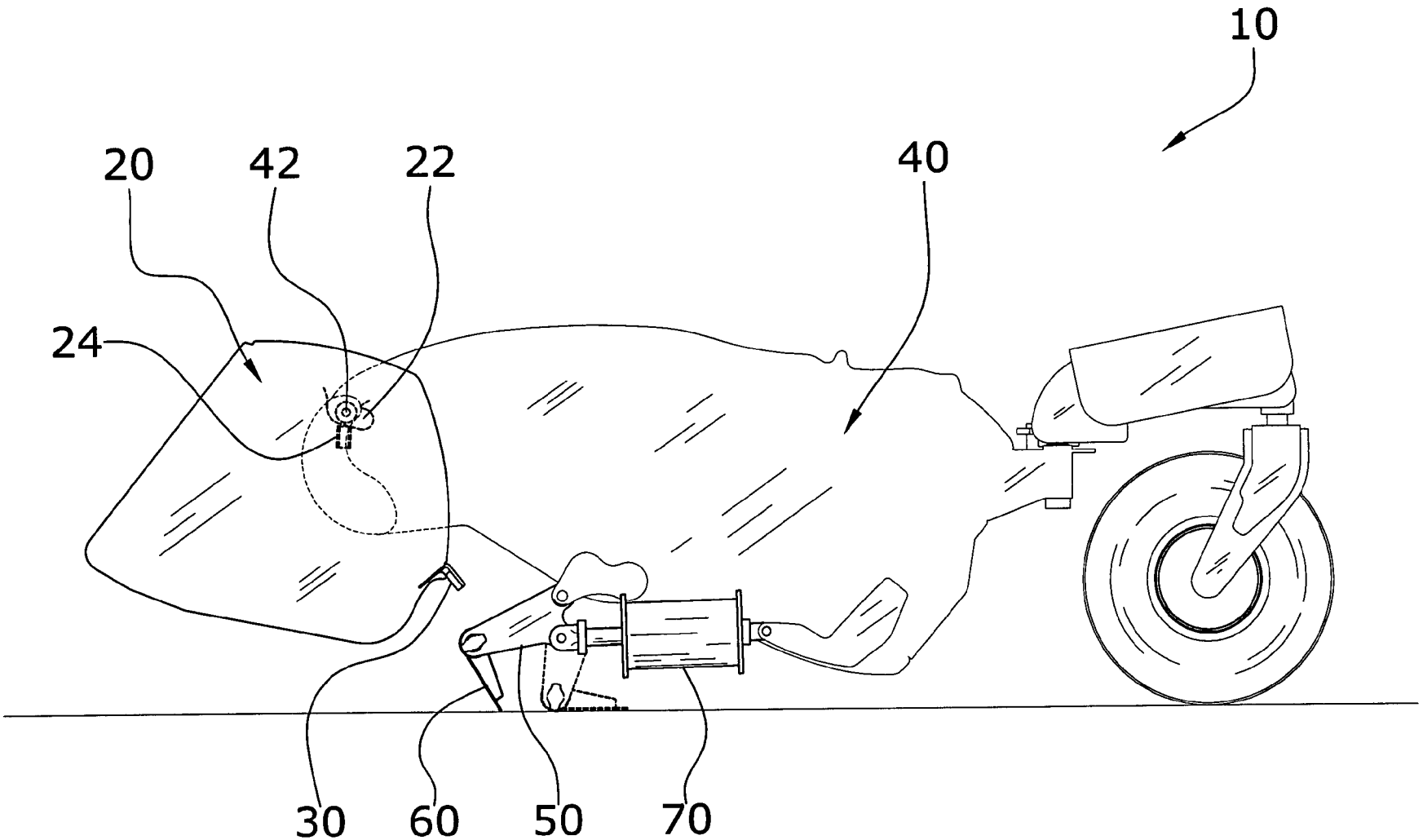
FIG. 3 is a side view of the present invention between the support stand position and the locking position
Figure 4:
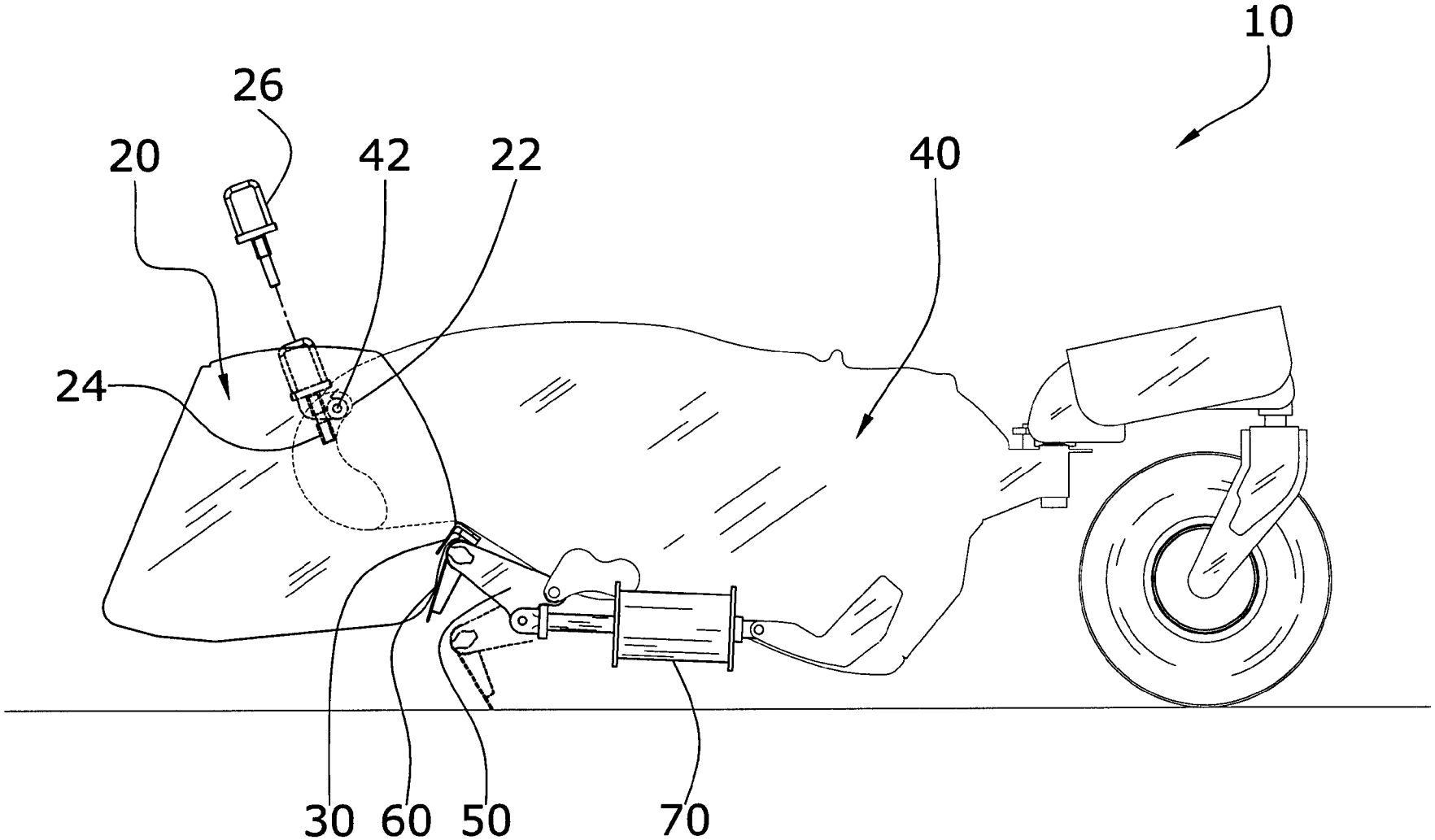
FIG. 4 is a side view of the present invention in the locking position to prevent movement of the bucket.
Figure 5:
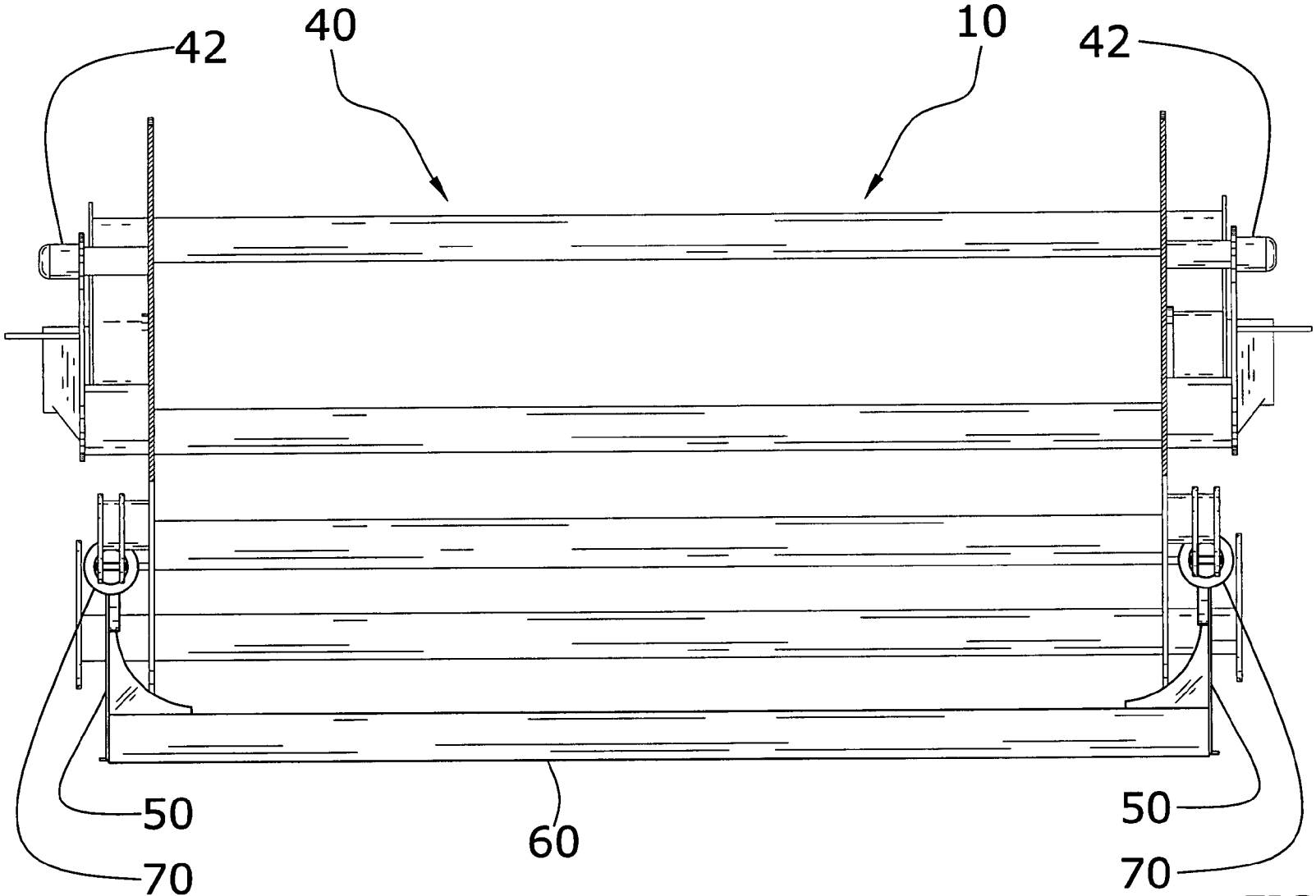
FIG. 5 is a cross sectional view taken along line 4-4 of FIG. 2.

The arm member 50 is pivotally attached to the implement 40 as shown in FIGS. 1 through 7 of the drawings. A distal portion of the arm member 50 is capable of engaging the locking bracket 30 for locking the bucket 20 in a substantially non-movable position with respect to the implement 40 as best illustrated in FIG. 4 of the drawings. One or more arm members 50 may be pivotally attached to the implement 40 as illustrated in FIG. 5 of the drawings.

F. Actuator

An actuator 70 is connected between the arm member 50 and the implement 40 for manipulating the arm member 50 into the support position and the locking position as shown in FIGS. 2, 3, 4, 6 and 7. The actuator 70 may be comprised of various devices such as but not limited hydraulic cylinders and electrically powered devices.

When in the support position, the arm member 50 is positioned substantially vertically to support the implement 40 while allowing pivoting of the bucket 20 with respect to the implement 40 as illustrated in FIG. 2 of the drawings. When in the locking position, the arm member 50 is positioned substantially horizontal and/or angled upwardly for securing the bucket 20 into the substantially non-movable position as illustrated in FIG. 4 of the drawings.

G. Support Stand

A support stand 60 is attached to the arm member 50 for supporting the implement 40 when the arm member 50 is in the support position. The support stand 60 is comprised of a substantially broad structure for providing a broad support base for use in softer ground surfaces (e.g. sand, wet soil). The support stand 60 preferably extends between opposing sides of the implement 40 as best illustrated in FIG. 5 of the drawings. When two or more arm members 50 are utilized, the support stand 60 preferably is attached to the arm members 50 as shown in FIG. 5 of the drawings.

H. Operation

Figure 6:
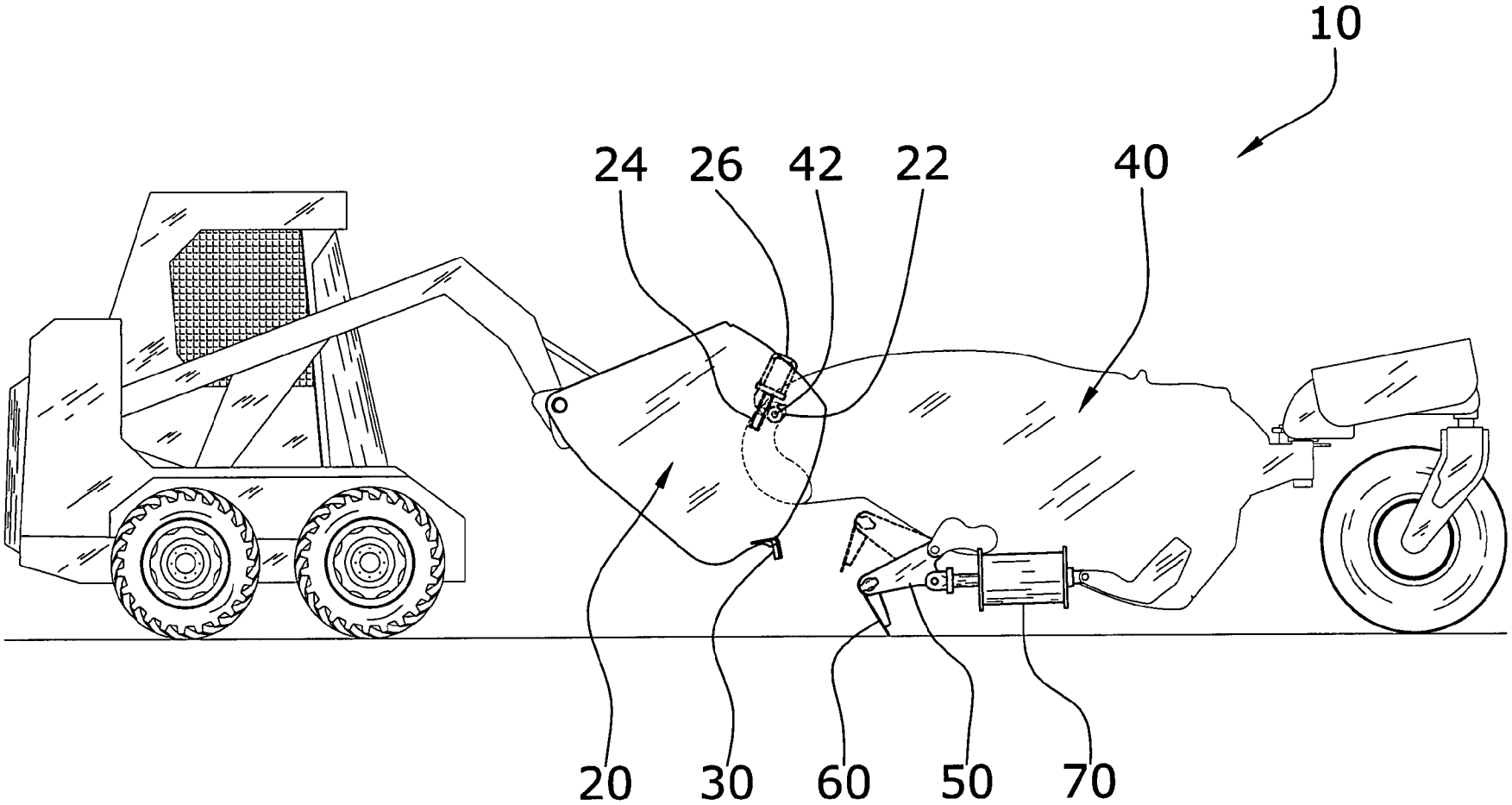
FIG. 6 is a side view of the present invention removed from the locked position and with the bucket being partially tilted with respect to the implement.
Figure 7:
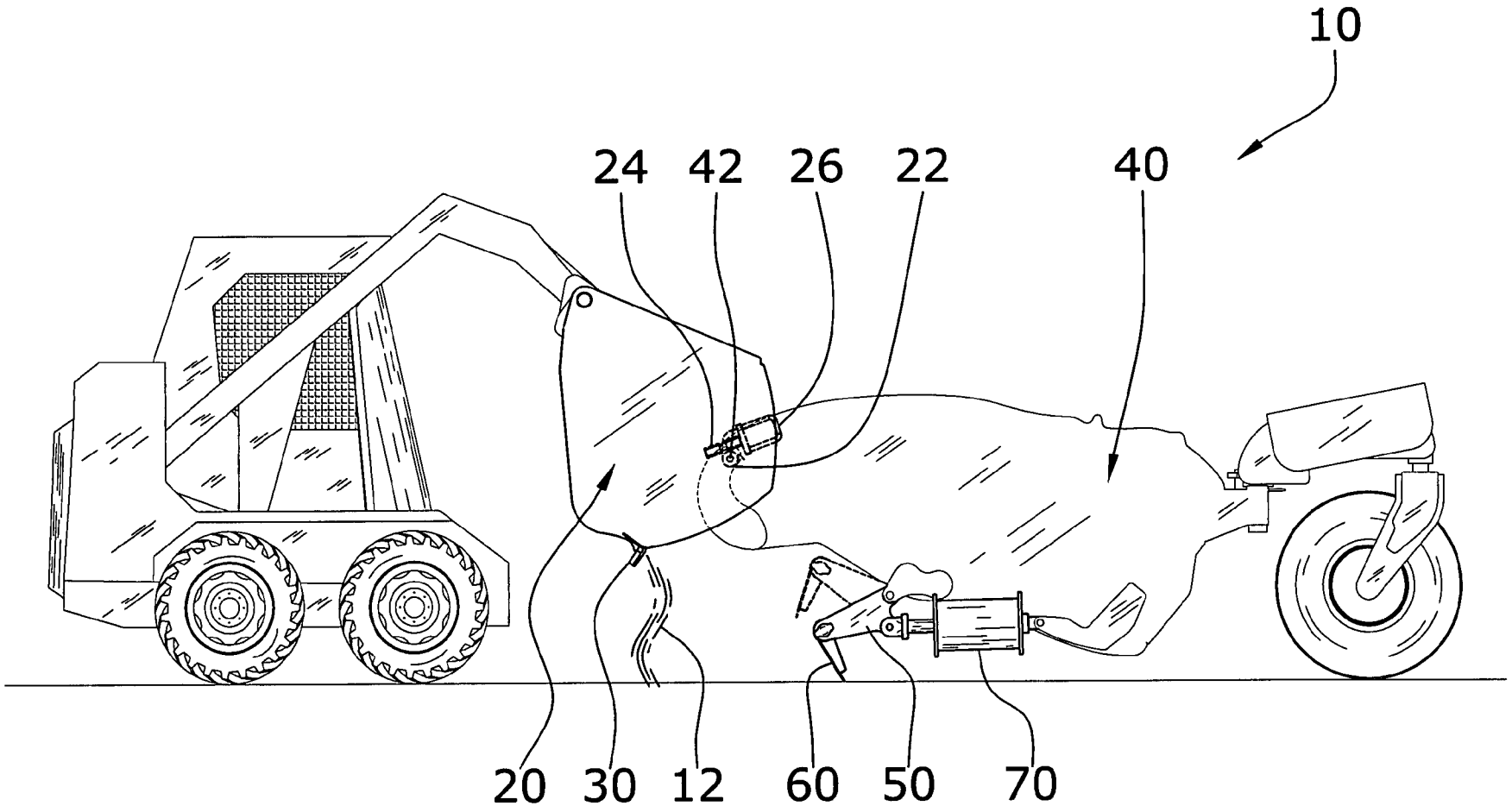
FIG. 7 is a side view of the present invention with the bucket fully tilted for allowing dumping of the contents within the bucket.
Figure 8:
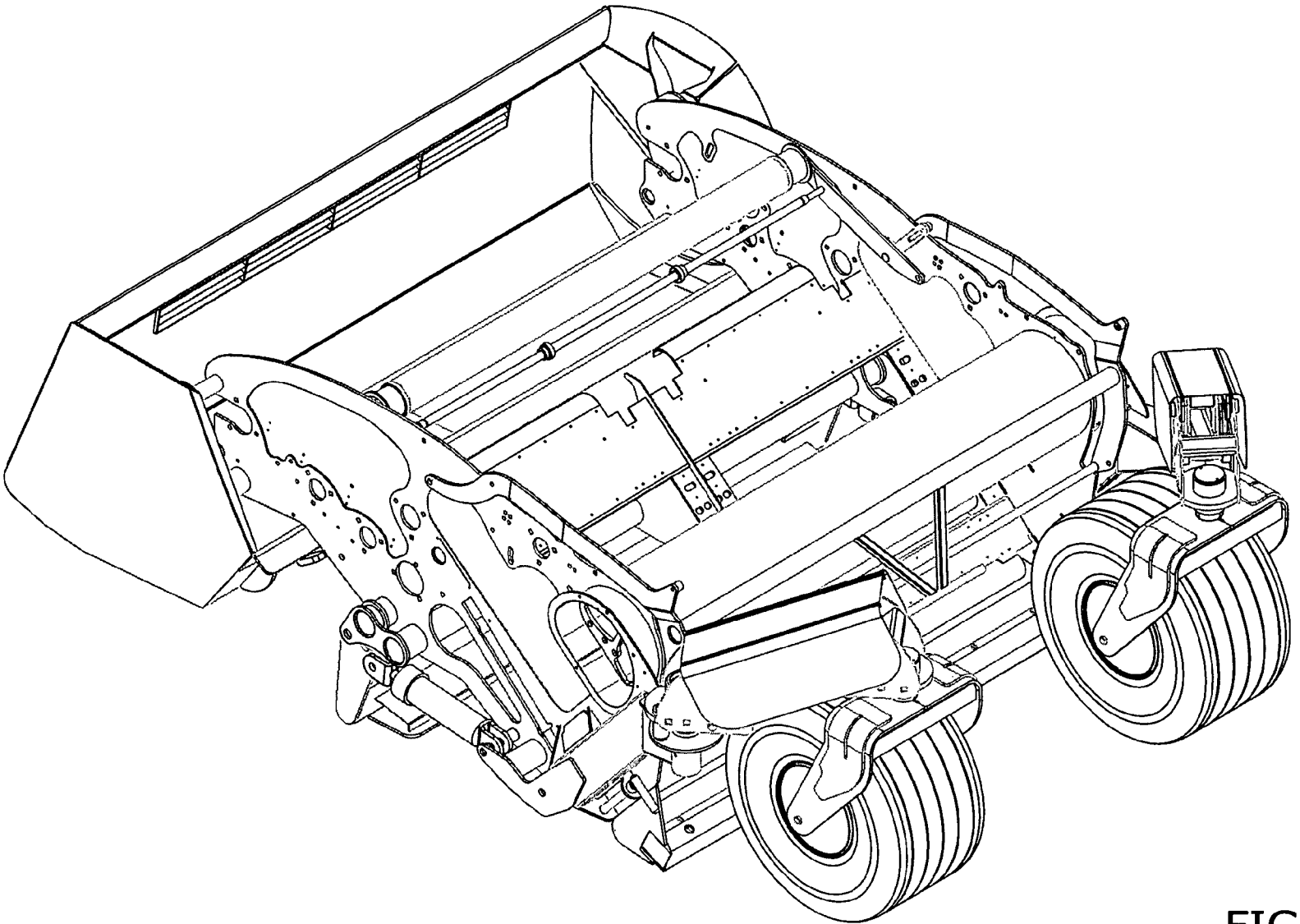
FIG. 8 is an upper perspective view of the present invention.
Figure 9:
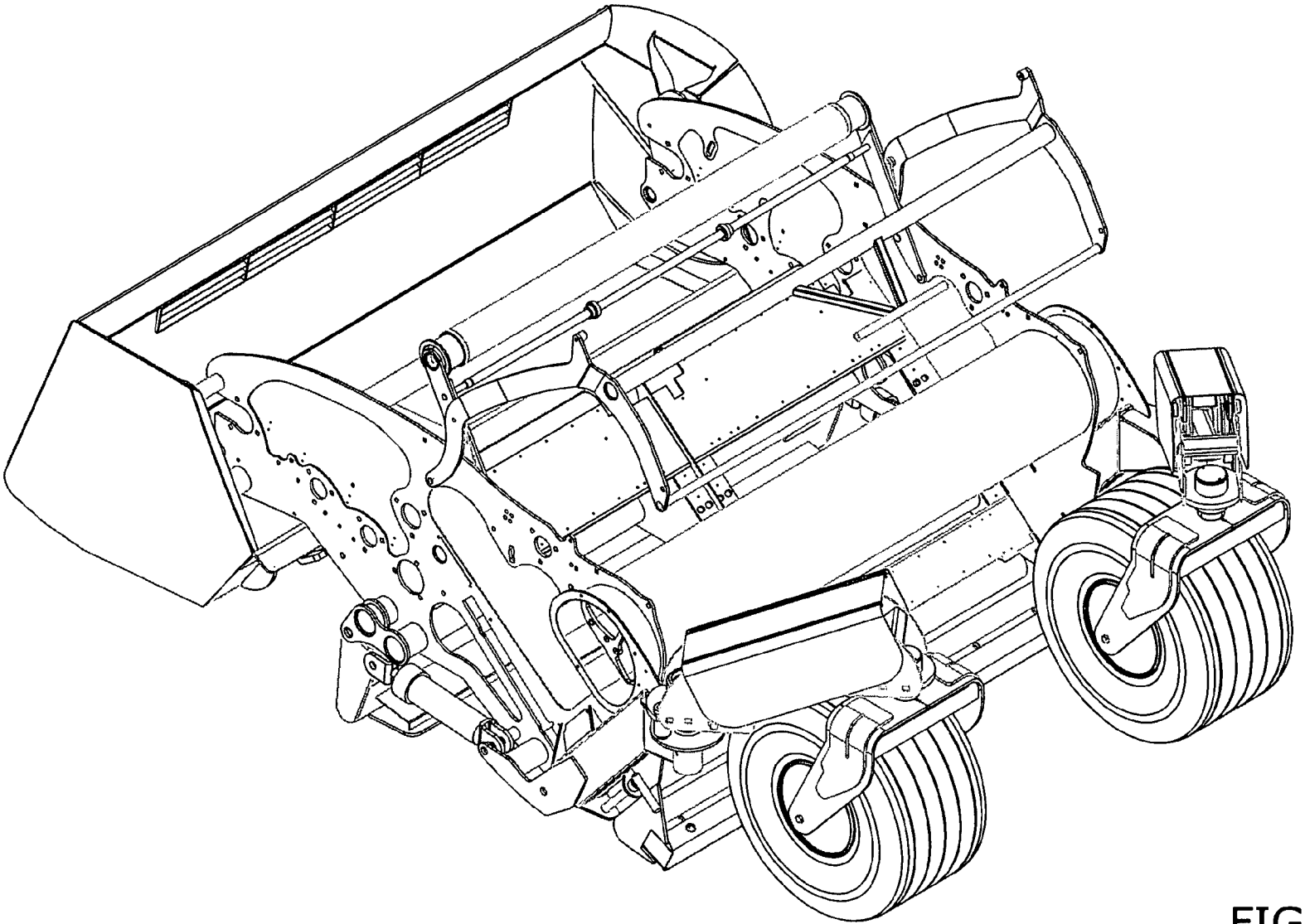
FIG. 9 is an upper perspective view of the present invention.

The bucket 20 is attached to a conventional front end load on a tractor (e.g. skid steer tractor). With the arm member 50 in the support position, the user connects the bucket 20 with the implement 40 by positioning the securing pins 42 within the receiver slots 22 of the bucket 20 (or vice versa if the receiver slots 22 are within the implement 40) as shown in FIGS. 2 and 3 of the drawings. When the securing pins 42 are fully positioned within the receivers slots of the bucket 20, the user then positions the locking pins 26 within the locking apertures 24 of the bucket 20 to securing the securing pins 42 within the receiver slots 22 as illustrated in FIGS. 4, 6 and 7 of the drawings. Once the locking pins 26 are secured, the bucket 20 is pivotally attached to the implement 40 as illustrated in FIG. 6 of the drawings.

The user then preferably tilts the bucket 20 so that the bucket 20 is a substantially horizontal position as illustrated in FIG. 4 of the drawings. The user then manipulates the actuator 70 to extend the arm member 50 into the locking position whereby the distal portion of the arm member 50 (and the support stand 60) engage the locking bracket 30 as shown in FIG. 4 of the drawings. The bucket 20 is thereby not allowed to substantially pivot with respect to the implement 40 and the bucket 20 becomes part of the implement 40 for all intensive purposes. The implement 40 is operated normally. For example, if the implement 40 is a ground surface cleaning machine, the debris 12 is collected and transferred via cleaning chains to the interior portion of the bucket 20.

After the bucket 20 has become full or partially full of debris 12, the user then releases the arm member 50 from the locking position by manipulating the actuator 70 as shown in FIGS. 6 and 7 of the drawings. After the arm member 50 is removed from the locking position, the user is then able to pivot the bucket 20 (utilizing the front end loader of the tractor) to allow for dumping of the debris 12 as shown in FIGS. 6 and 7 of the drawings. When the debris 12 is fully removed, the user then pivots the bucket 20 back to the non-movable position with the arm member 50 repositioned to the locking position as shown in FIG. 4 of the drawings to continue usage of the implement 40.

To remove the bucket 20 from the implement 40, the arm member 50 is positioned into the support position as shown in FIG. 2 of the drawings. The user then removes the locking pins 26 from the bucket 20 and then manipulates the bucket 20 so that the bucket 20 is removed from the securing pins 42 of the implement 40.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A combination support stand and bucket locking system, comprising:

a bucket;

a locking bracket extending from said bucket;

an implement that pivotally attaches with said bucket;

an arm member pivotally attached to said implement, wherein a distal portion of said arm member is capable of engaging said locking bracket for locking said bucket in a substantially non-movable position with respect to said implement; and an actuator connected between said arm member and said implement for manipulating said arm member into a support position and a locking position, wherein said support position positions said arm member to support said implement while allowing pivoting of said bucket with respect to the implement, and wherein said locking position positions said arm member for securing said bucket into said substantially non-movable position;

wherein said arm member includes a support stand for supporting said implement when said arm member is in said support position.

2. The combination support stand and bucket locking system of claim 1, wherein said support stand is comprised of a substantially broad structure.

3. The combination support stand and bucket locking system of claim 1, wherein said support stand extends between opposing sides of said implement.

4. The combination support stand and bucket locking system of claim 1, wherein said locking bracket extends from a front end of said bucket.

5. The combination support stand and bucket locking system of claim 4, wherein said locking bracket extends forwardly from said bucket.

6. The combination support stand and bucket locking system of claim 1, wherein said bucket includes a pair of receiver slots and wherein said implement includes a pair of securing pins that are pivotally received within said receiver slots for pivotally connecting said bucket with said implement.

7. The combination support stand and bucket locking system of claim 6, including a pair of locking apertures extending into said bucket adjacent to said receiver slots and a pair of locking pins removably extendable within said locking apertures, wherein said locking pins prevent removal of said securing pins from said receiver slots.

8. The combination support stand and bucket locking system of claim 1, wherein said locking bracket extends substantially an entire width of said bucket.

9. The combination support stand and bucket locking system of claim 1, wherein a front portion of said bucket is pivotally attached to a rear portion of said implement.

10. A combination support stand and bucket locking system, comprising:

a bucket;

a locking bracket extending from said bucket;

an implement that pivotally attaches with said bucket, wherein said bucket includes a pair of receiver slots and wherein said implement includes a pair of securing pins that are pivotally received within said receiver slots for pivotally connecting said bucket with said implement;

an arm member pivotally attached to said implement, wherein a distal portion of said arm member is capable of engaging said locking bracket for locking said bucket in a substantially non-movable position with respect to said implement;

an actuator connected between said arm member and said implement for manipulating said arm member into a support position and a locking position, wherein said support position positions said arm member to support said implement while allowing pivoting of said bucket with respect to the implement, and wherein said locking position positions said arm member for securing said bucket into said substantially non-movable position; and a pair of locking apertures extending into said bucket adjacent to said receiver slots and a pair of locking pins removably extendable within said locking apertures, wherein said locking pins prevent removal of said securing pins from said receiver slots.

11. The combination support stand and bucket locking system of claim 10, wherein said arm member includes a support stand for supporting said implement when said arm member is in said support position.

12. The combination support stand and bucket locking system of claim 11, wherein said support stand is comprised of a substantially broad structure.

13. The combination support stand and bucket locking system of claim 11, wherein said support stand extends between opposing sides of said implement.

14. The combination support stand and bucket locking system of claim 10, wherein said locking bracket extends from a front end of said bucket.

15. The combination support stand and bucket locking system of claim 14, wherein said locking bracket extends forwardly from said bucket.

16. The combination support stand and bucket locking system of claim 10, wherein said locking bracket extends substantially an entire width of said bucket.

17. The combination support stand and bucket locking system of claim 10, wherein a front portion of said bucket is pivotally attached to a rear portion of said implement.

18. A combination support stand and bucket locking system, comprising:

a bucket;

a locking bracket extending from said bucket, wherein said locking bracket extends from a front end of said bucket, wherein said locking bracket extends forwardly from said bucket, wherein said locking bracket extends substantially an entire width of said bucket;

an implement that pivotally attaches with said bucket, wherein said bucket includes a pair of receiver slots and wherein said implement includes a pair of securing pins that are pivotally received within said receiver slots for pivotally connecting said bucket with said implement, wherein a front portion of said bucket is pivotally attached to a rear portion of said implement;

an arm member pivotally attached to said implement, wherein a distal portion of said arm member is capable of engaging said locking bracket for locking said bucket in a substantially non-movable position with respect to said implement, wherein said arm member includes a support stand for supporting said implement when said arm member is in said support position, wherein said support stand is comprised of a substantially broad structure, wherein said support stand extends between opposing sides of said implement;

an actuator connected between said arm member and said implement for manipulating said arm member into a support position and a locking position, wherein said support position positions said arm member to support said implement while allowing pivoting of said bucket with respect to the implement, and wherein said locking position positions said arm member for securing said bucket into said substantially non-movable position; and a pair of locking apertures extending into said bucket adjacent to said receiver slots and a pair of locking pins removably extendable within said locking apertures, wherein said locking pins prevent removal of said securing pins from said receiver slots.

* * * * *